US009945016B2

(12) United States Patent
Inoue et al.

(10) Patent No.: US 9,945,016 B2
(45) Date of Patent: Apr. 17, 2018

(54) HEAT-RESISTANT AUSTENITIC STAINLESS STEEL SHEET

(71) Applicant: NIPPON STEEL & SUMIKIN STAINLESS STEEL CORPORATION, Tokyo (JP)

(72) Inventors: Yoshiharu Inoue, Kitakyushu (JP); Nobuhiko Hiraide, Hikari (JP); Atsuhisa Yakawa, Tokyo (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 176 days.

(21) Appl. No.: 14/779,364

(22) PCT Filed: Mar. 28, 2014

(86) PCT No.: PCT/JP2014/059251

§ 371 (c)(1),
(2) Date: Sep. 23, 2015

(87) PCT Pub. No.: WO2014/157655

PCT Pub. Date: Oct. 2, 2014

(65) Prior Publication Data

US 2016/0032434 A1 Feb. 4, 2016

(30) Foreign Application Priority Data

Mar. 28, 2013 (JP) ..... 2013-069220

(51) Int. Cl.

| | |
|---|---|
| ***C22C 38/58*** | (2006.01) |
| ***C22C 38/42*** | (2006.01) |
| ***C22C 38/00*** | (2006.01) |
| ***C22C 38/04*** | (2006.01) |
| ***C22C 38/06*** | (2006.01) |
| ***C22C 38/34*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C21D 6/00*** | (2006.01) |
| ***C21D 9/46*** | (2006.01) |
| ***C22C 38/18*** | (2006.01) |
| *C21D 8/02* | (2006.01) |

(52) U.S. Cl.

CPC ..... *C22C 38/58* (2013.01); *C21D 6/004* (2013.01); *C21D 9/46* (2013.01); *C22C 38/00* (2013.01); *C22C 38/001* (2013.01); *C22C 38/002* (2013.01); *C22C 38/008* (2013.01); *C22C 38/04* (2013.01); *C22C 38/06* (2013.01); *C22C 38/18* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 8/0226* (2013.01); *C21D 8/0236* (2013.01); *C21D 8/0273* (2013.01); *C21D 2211/001* (2013.01)

(58) Field of Classification Search

CPC ..... C22C 38/22; C22C 38/04; C22C 38/06; C22C 38/34; C22C 38/42; C22C 38/44; C22C 38/46; C22C 38/48; C22C 38/50; C22C 38/52; C22C 38/54; C22C 38/002; C22C 38/18

See application file for complete search history.

(56) References Cited

U.S. PATENT DOCUMENTS

| | | | |
|---|---|---|---|
| 2008/0107559 A1 | 5/2008 | Nishiyama et al. | |
| 2013/0336834 A1 | 12/2013 | Matsuhashi et al. | |

FOREIGN PATENT DOCUMENTS

| | | | | |
|---|---|---|---|---|
| CN | 102230137 A | | 11/2011 | |
| CN | 102363870 A | | 2/2012 | |
| CN | 102877006 A | | 1/2013 | |
| EP | 2108710 A1 | * | 10/2009 | ..... C21D 3/06 |
| JP | 51-4015 A | | 1/1976 | |
| JP | 52-109420 A | | 9/1977 | |
| JP | 56-24028 A | | 6/1981 | |
| JP | 2-213451 A | | 8/1990 | |
| JP | 5-320756 A | | 12/1993 | |
| JP | 2970432 B2 | | 11/1999 | |
| JP | 2003-082441 | * | 3/2003 | ..... C22C 38/00 |
| JP | 2010-202936 A | | 9/2010 | |

(Continued)

OTHER PUBLICATIONS

English Abstract and English Machine Translation of JP 2003-082441 (Mar. 19, 2003).*

Korean Office Action dated Dec. 19, 2016, for Korean Application No. 10-2015-7028931, with partial English translation.

Chinese Office Action and Search Report, dated May 5, 2016, for counterpart Chinese Application No. 201480017607.9, with English Translation of the Search Report.

Extended European Search Report, dated Aug. 29, 2016, for counterpart European Application No. 14774814.9.

International Preliminary Report on Patentability, issued in PCT/JP2014/059251, dated Mar. 2, 2015.

(Continued)

*Primary Examiner* — Jessee Roe

(74) *Attorney, Agent, or Firm* — Birch, Stewart, Kolasch & Birch, LLP

(57) ABSTRACT

This heat-resistant austenitic stainless steel sheet contains, in mass %, C: 0.05 to 0.15%, Si: 1.0 to 3.5%, Mn: 0.5 to 2.0%, P: not more than 0.04%, S: not more than 0.01%, Cr: 23.0 to 26.0%, Ni: 10.0 to 15.0%, Mo: 0.50 to 1.20%, Ti: not more than 0.1%, Al: 0.01 to 0.10% and N: 0.10 to 0.30%, wherein the total amount of C and N (C+N) is from 0.25 to 0.35%, and the balance is composed of Fe and unavoidable impurities. The heat-resistant austenitic stainless steel can be used in a high-temperature environment that reaches a maximum temperature of 1,100° C.

9 Claims, No Drawings

(56) References Cited

FOREIGN PATENT DOCUMENTS

| | | | |
|---|---|---|---|
| JP | 2012-1749 | A | 1/2012 |
| WO | WO 2012/133574 | A1 | 10/2012 |

OTHER PUBLICATIONS

International Search Report, issued in PCT/JP2014/059251, dated Jun. 3, 2014.
Written Opinion of the International Searching Authority, issued in PCT/JP2014/059251, dated Jun. 3, 2014.

* cited by examiner

HEAT-RESISTANT AUSTENITIC STAINLESS STEEL SHEET

TECHNICAL FIELD

The present invention relates to a heat-resistant austenitic stainless steel sheet used in a high-temperature environment that reaches a maximum temperature of 1,100° C.

Priority is claimed on Japanese Patent Application No. 2013-069220, filed Mar. 28, 2013, the content of which is incorporated herein by reference.

BACKGROUND ART

In recent years, stricter exhaust gas regulations for vehicles have created a trend aimed at pursuing improved engine efficiency. As the combustion efficiency of engines is improved, the temperature of the exhaust gas tends to increase. Further, there is also a trend toward significantly increased use of superchargers typified by turbochargers. As a result, the components of exhaust manifolds and turbocharger housings and the like require superior heat resistance. It is thought that future trends will see the exhaust gas temperature reaching 1,100° C. Conventionally, if this temperature region is reached, then in many cases, cast steel is used instead of stainless steel sheets, but this results in various problems, including increased weight, a reduction in thermal efficiency due to a larger heat capacity, and a significant reduction in the temperature in the downstream exhaust gas-purifying catalytic converter, resulting in a deterioration in the catalyst efficiency. Accordingly, a stainless steel sheet that can be used at temperatures up to a maximum temperature of 1,100° C. has been keenly sought.

Representative examples of known heat-resistant austenitic stainless steels include SUS310S (25Cr-20Ni) and SUSXM15J1 (19Cr-13Ni-3Si), but it is doubtful that these types of steel could be used in an environment having a maximum temperature of 1,100° C.

Examples of austenitic stainless steels having heat resistance that exceeds that of SUS310S and SUSXM15J1 include a steel disclosed in Patent Document 1 and a steel disclosed in Patent Document 2, but these steels are also not intended for use at temperatures of up to 1,100° C. Accordingly, a stainless steel sheet that can be used at temperatures up to a maximum temperature of 1,100° C. is not currently available.

PRIOR ART LITERATURE

Patent Documents

Patent Document 1: Japanese Examined Patent Application, Second Publication No. S56-24028

Patent Document 2: Japanese Unexamined Patent Application, First Publication No. 2010-202936

DISCLOSURE OF INVENTION

Problems to be Solved by the Invention

Conventional austenitic stainless steel sheets do not have satisfactory high-temperature strength or oxidation resistance at 1,100° C., and therefore use of such steels in environments where the maximum temperature reaches 1,100° C. has been problematic. Accordingly, an object of the present invention is to provide a heat-resistant austenitic stainless steel sheet that can be used in a high-temperature environment that reaches a maximum temperature of 1,100° C.

Means for Solving the Problems

In order to develop a heat-resistant austenitic stainless steel sheet that could be used in a high-temperature environment that reaches a temperature of 1,100° C., the inventors of the present invention first investigated the properties required for an austenitic stainless steel sheet at 1,100° C. As a result, they decided that in terms of the high-temperature strength, it was necessary to prevent deformation, and that therefore the steel should be evaluated using the 0.2% proof stress as an indicator. Further, in terms of the oxidation resistance, austenitic stainless steel sheets have a larger coefficient of thermal expansion than ferritic stainless steel sheets, and therefore the inventors thought that for those cases where the stainless steel was used in a region exposed to extreme temperature variation, such as a vehicle exhaust system, it was more appropriate to evaluate the oxidation resistance by a cyclic oxidation test in which the maximum temperature and room temperature were cycled repeatedly rather than a continuous oxidation test in which the maximum temperature was maintained, and they therefore decided to evaluate the oxidation resistance by a cyclic oxidation test in which 1,100° C. and room temperature were cycled repeatedly. As a result, they discovered that current stainless steel sheets conventionally used in environments of 1,000° C. actually exhibited unsatisfactory heat resistance at 1,100° C.

The inventors of the present invention then undertook further investigations, and discovered that in relation to the high-temperature strength of an austenitic stainless steel that could be used in a high-temperature environment that reaches a maximum temperature of 1,100° C., the addition of C, N and Mo was effective. In austenitic stainless steel, C and N improve the high-temperature strength even when added individually, but it became clear that be adding C and N in combination with Mo, the high-temperature strength at temperatures of 1,000° C. or higher could be particularly enhanced. It is surmised that this may be an effect due to an interaction between C, N and Mo, for example the formation of clusters. Moreover, it was discovered that adding one or more elements selected from among Nb, V, W and Co in addition to the C, N and Mo was also effective. It is surmised that the addition of one or more elements selected from among Nb, V, W and Co to the austenitic stainless steel exhibits a similar action to the effect of adding Mo to C and N. However, it was ascertained that if the one or more elements selected from among Nb, V, W and Co were added to the austenitic stainless steel in excess, then carbonitrides were formed, and an increase in coarseness resulted in a reduction in the high-temperature strength improvement effect.

Further, the inventors discovered that in relation to the oxidation resistance of the austenitic stainless steel, the addition of an appropriate amount of Mo in addition to Cr, and Si and Mn, and suppression of the amount of Ti added were necessary. In particular, they found that the addition of Si and Mo to the austenitic stainless steel was very important, as it suppressed scale growth and spallation, and dramatically reduced oxidation weight loss (reduction in thickness) in the 1,100° C. cyclic oxidation test. Further, they also found that because the addition of Ti to the austenitic stainless steel promoted scale growth and spallation, the addition of Ti should preferably be suppressed as far as possible.

The present invention was completed on the basis of these findings, and aspects of the present invention for achieving the object described above, namely austenitic stainless steel sheets of the present invention, are as described below.

(1) A heat-resistant austenitic stainless steel sheet containing, in mass %, C: 0.05 to 0.15%, Si: 1.0 to 3.5%, Mn: 0.5 to 2.0%, P: not more than 0.04%, S: not more than 0.01%, Cr: 23.0 to 26.0%, Ni: 10.0 to 15.0%, Mo: 0.50 to 1.20%, Ti: not more than 0.1%, Al: 0.01 to 0.10% and N: 0.10 to 0.30%, wherein the total amount of C and N (C+N) is from 0.25 to 0.35%, and the balance is composed of Fe and unavoidable impurities.

(2) The heat-resistant austenitic stainless steel sheet disclosed in (1), further containing, in mass %, one or more of Nb: 0.01 to 0.5%, V: 0.01 to 0.5%, W: 0.01 to 0.5% and Co: 0.01 to 0.5%, wherein the total amount of Mo, Nb, V, W and Co (Mo+Nb+V+W+Co) is not more than 1.5%.

(3) The heat-resistant austenitic stainless steel sheet disclosed in (1) or (2), further containing, in mass %, one or more of Cu: 0.1 to 2.0%, B: 0.0001 to 0.01% and Sn: 0.005 to 0.1%.

(4) The heat-resistant austenitic stainless steel sheet disclosed in any one of (1) to (3), wherein the high-temperature strength at 1,100° C., measured as a 0.2% proof stress, is 20 MPa or greater.

(5) The heat-resistant austenitic stainless steel sheet disclosed in any one of (1) to (3), wherein the high-temperature strength at 1,100° C., measured as a 0.2% proof stress, is 30 MPa or greater.

(6) The heat-resistant austenitic stainless steel sheet disclosed in any one of (1) to (5), wherein weight loss in a 1,100° C. cyclic oxidation test is not more than 50 mg/cm$^2$.

Effects of the Invention

The heat-resistant austenitic stainless steel of the present invention not only exhibits excellent high-temperature strength and oxidation resistance, but also displays superior workability, and therefore a stainless steel sheet with excellent heat resistance can be provided.

BEST MODE FOR CARRYING OUT THE INVENTION

Embodiments of the present invention are described below. First is a description of the reasons for restricting the steel composition of the stainless steel sheet of the embodiments of the present invention. Unless particularly stated otherwise, values used in relation to the composition refer to mass % values.

(C: 0.05 to 0.15%)

C is effective in improving the high-temperature strength of the austenitic stainless steel. This improvement effect is particularly evident in the temperature region exceeding 600° C. It is thought that this improvement is not an effect of stand-alone C, but is rather due to interactions with N and other alloy elements (such as Mo, Nb and V). However, excess C tends to facilitate the formation of Cr carbides, which can cause a deterioration in the formability, corrosion resistance and toughness of hot-rolled sheet/coil. Accordingly, the appropriate addition amount for C is set to 0.05 to 0.15%. The amount of C added is more preferably from 0.07% to 0.15%.

(N: 0.10 to 0.30%)

In a similar manner to C, N is effective in improving the high-temperature strength of the austenitic stainless steel. This improvement effect is particularly evident in the temperature region exceeding 600° C. It is thought that this improvement is not an effect of stand-alone N, but is rather due to interactions with N and other alloy elements (such as Mo, Nb and V). However, excess N tends to facilitate formation of Cr nitrides, which can cause a deterioration in the formability, corrosion resistance and toughness of hot-rolled sheet/coil. Accordingly, the appropriate addition amount for N is set to 0.1 to 0.30%. The amount of N added is more preferably from 0.15% to 0.25%.

(C+N: 0.25 to 0.35%)

Both C and N have an effect in improving the high-temperature strength, but in order to achieve a satisfactory effect, the total amount of C and N added (C+N) must be at least 0.25%. However, excessive addition tends to cause the formation of coarse carbonitrides, which not only reduce the high-temperature strength improvement effect, but also cause a deterioration in the workability, and therefore the upper limit is set to 0.35%. The total amount of C and N added is more preferably from 0.30% to 0.35%.

(Si: 1.0 to 3.5%)

Si is an element that is not only useful as a deoxidizing agent, but also improves the oxidation resistance of the austenitic stainless steel, and is an important element in the present invention. The oxidation resistance increases as the amount of Si is increased.

This effect is realized when the Si content is at least 1.0%, and therefore the lower limit is set to 1.0%. The effect is more definite at amounts exceeding 1.5%. However, Si is an element that causes a large reduction in the toughness, and excessive addition causes deterioration in the toughness and the normal-temperature ductility. Accordingly, the Si content is restricted to not more than 3.5%, and more preferably 2.0% or less. The Si content is more preferably within a range from 1.60% to 2.0%.

(Mn: 0.5 to 2.0%)

Mn is an austenite-stabilizing element, and is added to the austenitic stainless steel as a deoxidizing agent. Further, Mn is also an element that contributes to an increase in high-temperature strength in the intermediate temperature region. In order to reduce the amount of expensive Ni, at least 0.5% of Mn is added. On the other hand, excessive addition of Mn results in the formation of MnS and a deterioration in the corrosion resistance, and therefore the upper limit for the amount of added Mn is set to 2.0%. The amount of Mn added is more preferably from 0.7% to 1.6%.

(P: Not More than 0.04%)

P is an element that is incorporated unavoidably during production, but because it has an adverse effect on the weldability, the P content must be reduced as far as possible. Accordingly, the P content in the austenitic stainless steel is set to not more than 0.04%. The P content is preferably 0.03% or less. There are no particular limitations on the lower limit for the P content, but 0.015% is typically unavoidably incorporated.

(S: Not More than 0.01%)

S is an element that is incorporated unavoidably during production, and has an adverse effect on the weldability, Further, S forms MnS, which causes a deterioration in the corrosion resistance and the oxidation resistance. Accordingly, the S content in the austenitic stainless steel must be reduced as far as possible, and is set to not more than 0.01%. The S content is preferably 0.002% or less. There are no particular limitations on the lower limit for the S content, but 0.0010% is typically unavoidably incorporated.

(Cr: 23.0 to 26.0%)

Cr is an element that is essential in ensuring the oxidation resistance and corrosion resistance of the austenitic stainless steel. However, if added in excess, Cr is an element that tends to increase the occurrence of 6-brittleness. Accordingly, the appropriate range for the amount of added Cr is set to 23.0 to 26.0%. The amount of Cr added is more preferably from 23.0% to 25.0%.

(Ni: 10.0 to 15.0%)

Ni is an austenite-stabilizing element, and is an element that improves the corrosion resistance of the austenitic stainless steel. If the amount of Ni is too small, then the austenite phase is not formed stably, and therefore at least 10.0% of Ni is added. However, because Ni is an expensive element, excessive addition results in increased costs. Accordingly, the upper limit for the amount of added Ni is set to 15.0%. The amount of Ni added is more preferably from 11.0% to 14.0%.

(Mo: 0.50 to 1.20%)

Mo is an important element in the present invention. Mo is an element that enhances the high-temperature strength of the austenitic stainless steel. This effect is thought to be due to solid solution strengthening, but in the present invention, when Mo coexists with C and N, a strengthening effect that exceeds that due to simple solid solution strengthening is realized. The mechanism for this effect is not entirely clear, but it is thought that there is a possibility that some strengthening is due to interactions between Mo and either C or N, such as the formation of clusters. On the other hand, excessive addition of Mo facilitates the formation of a σ-phase. Accordingly, the appropriate range for the amount of added Mo is set to 0.50 to 1.20%. When high-temperature strength is particularly necessary, the amount of Mo added is more preferably from 1.0% to 1.2%.

(Ti: Not More than 0.1%)

Ti is an element that readily binds to N to form a coarse nitride (TiN). In the present invention, because N is used for high-temperature strengthening, the formation of coarse TiN tends to cause a deterioration in the high-temperature properties. Further, Ti also has an adverse effect on the oxidation resistance. Accordingly, in the present invention, the amount of Ti in the austenitic stainless steel must be reduced as far as possible, and the upper limit for the Ti content is set to 0.1%. There are no particular limitations on the lower limit for the Ti content, but 0.010% is typically unavoidably incorporated.

(Al: 0.01 to 0.10%)

Al acts as a deoxidizing element, and this effect is realized when the amount of Al added to the austenitic stainless steel is at least 0.005%. However, excessive addition can cause deterioration in the normal-temperature ductility and toughness, and therefore the upper limit for the amount of added Al is set to 0.10%. The amount of Al added is more preferably from 0.02% to 0.07%.

In order to further improve the high-temperature properties, one or more of Nb: 0.01 to 0.5%, V: 0.01 to 0.5%, W: 0.01 to 0.5% and Co: 0.01 to 0.5% may be added to the austenitic stainless steel. These elements enhance the high-temperature strength. When high-temperature strength is particularly necessary, the amounts added of these elements are more preferably Nb: 0.1 to 0.5%, V: 0.1 to 0.5%, W: 0.1 to 0.5% and Co: 0.1 to 0.5%. Like Mo, the effect of these elements is thought to be due to solid solution strengthening, but it is surmised that the observed effects are not solely due to solid solution strengthening, and that some interactions with C or N also exist. Accordingly, because the addition of a large amount of these elements is undesirable due to the formation of coarse carbonitrides, the total amount of Mo, Nb, W, V and Co (Mo+Nb+W+V+Co) is preferably not more than 1.5%. Although there are no particular limitations on the lower limit for the total amount of Mo, Nb, W, V and Co, the lower limit is preferably at least 0.1%. When high-temperature strength is particularly necessary, it is more preferable that the total amount of Mo, Nb, W, V and Co exceeds 1.0%. However, excessive addition causes the formation of coarse carbonitrides, which actually reduce the high-temperature strength, and therefore even when high-temperature strength is required, the total amount of Mo, Nb, W, V and Co is preferably less than 1.2%.

Further, one or more of Cu, B and Sn may be added to the austenitic stainless steel to enhance the high-temperature strength in the intermediate region (600 to 800° C.) of the austenitic stainless steel.

(Cu: 0.1 to 2%)

Cu is an austenite-stabilizing element, and also has the effect of enhancing the high-temperature strength in the intermediate region of the austenitic stainless steel.

These effects are achieved when the amount of Cu added to the austenitic stainless steel is at least 0.1%. However, if added in excess, Cu can cause abnormal oxidation and surface defects during hot rolling, and therefore the upper limit for the amount of added Cu is set to 2%. The amount of Cu added is preferably from 0.1 to 1%, and more preferably from 0.1 to 0.5%.

(B: 0.0001 to 0.01%)

B is an element that has an effect in improving the high-temperature strength in the intermediate region of the austenitic stainless steel. This effect is achieved when the amount of B added to the austenitic stainless steel is at least 0.0001%. However, if added in excess, B causes a deterioration in the hot workability, and therefore the upper limit for the amount of added B is set to 0.01%. The amount of B added is more preferably from 0.0003% to 0.0050%.

(Sn: 0.005 to 0.1%)

Sn is an element that is effective in improving the corrosion resistance and the high-temperature strength in the intermediate region of the austenitic stainless steel. Further, it also has the effect of causing no significant deterioration in the normal-temperature mechanical properties of the austenitic stainless steel. The corrosion resistance effect is realized when the amount of Sn added to the austenitic stainless steel is at least 0.005%, and therefore the Sn content is preferably at least 0.005%, and more preferably 0.01% or greater. On the other hand, excessive addition causes a marked deterioration in the manufacturability and the weldability, and therefore the Sn content is restricted to not more than 0.1%.

The stainless steel according to the present invention containing the specified amounts of these components has extremely superior heat resistance properties.

The stainless steel according to the present invention was designed assuming use at 1,100° C., and therefore evaluations at 1,100° C. are used as benchmarks. First, the high-temperature strength at 1,100° C., measured as a 0.2% proof stress, is preferably 20 MPa or greater. The high-temperature strength at 1,100° C., measured as a 0.2% proof stress, is more preferably 30 MPa or greater. Moreover, the excellent heat resistance is reflected in a weight loss in a 1,100° C. cyclic oxidation test of not more than 50 mg/cm$^2$. The 1,100° C. cyclic oxidation testis a test that involves 300 repetitions of a cycle consisting of heating the steel to 1,100° C., holding that temperature for 30 minutes, and then cooling the steel from 1,100° C. to room temperature over a cooling period of 15 minutes.

The steel of the present invention is converted to a product via the steps of melting, casting, hot rolling, annealing, cold rolling, annealing, and pickling. There are no particular limitations on the facilities, and conventional production facilities can be used.

The effects of the present invention are described below using a series of examples, but the present invention is not limited to the conditions used in the following examples.

EXAMPLES

In the following examples, steels having the component formulations shown in Table 1A and Table 1B were first melted and cast into slabs. Subsequently, each slab was heated to 1,150 to 1,250° C., and then hot-rolled to a sheet thickness of 3 to 5 mm using a finishing temperature within a range from 850 to 950° C. The steel was then annealed at 1,000 to 1,200° C., pickled, cold-rolled to a thickness of 1.5 mm, and then annealed and pickled at 1,000 to 1,200° C. to form a test steel. In Table 1A and Table 1B, numerical values outside the ranges of the present invention are underlined.

Each of the cold-rolled annealed sheets obtained in this manner was subjected to tensile tests at normal temperature and high temperature, and a cyclic oxidation test. The normal-temperature tensile test was performed to evaluate the workability, and was conducted by preparing a JIS No. 13B test piece having a lengthwise direction parallel with the rolling direction in accordance with JIS Z 2201 (corresponding international standard: ISO 6892, 1984), and then performing a tensile test as prescribed in JIS Z 2241 (corresponding international standard: ISO 6892, 1984). The total elongation was used as an indicator of the workability, with a total elongation of 40% or greater deemed a pass (A), and a total elongation of less than 40% deemed a fail (C).

Further, the high-temperature tensile test was performed using a test piece with knife-edge ridges, with reference to JIS G 0567 (corresponding international standard: ISO 6892-2, 2011). The 1,100° C. 0.2% proof stress was used as an indicator of the high-temperature strength, and steels with a high-temperature strength of less than 20 MPa were deemed to have failed (C), steels of 20 MPa or greater were deemed to have passed (B), and steels of 30 MPa or greater were deemed superior steels (A).

The oxidation resistance was evaluated using a cyclic oxidation test. A sample of 20 mm×20 mm was cut from each steel sheet, and the end faces of the sample were buff-polished to a #600 finish to prepare an oxidation test piece. The test piece was then subjected to 300 repetitions of a cycle consisting of heating the steel to 1,100° C. in an open atmosphere, holding that temperature for 15 minutes, and then cooling the steel from 1,100° C. to room temperature over a cooling period of 15 minutes, and the oxidation weight loss (thickness loss due to scale formation and spallation) was measured. An oxidation weight loss of not more than 50 mg/cm$^2$ was deemed a pass (A), whereas a value exceeding 50 mg/cm$^2$ was deemed a fail (C). The evaluation results are shown in Table 2A and Table 2B.

TABLE 1A (mass %)

| | No. | C | Si | Mn | P | S | Ni | Cr | Mo | Ti | Al | N | C + N | Nb | V | W | Co | Mo + Nb + V + W + Co | Cu | B | Sn |
|---|---|---|---|---|---|---|---|---|---|---|---|---|---|---|---|---|---|---|---|---|---|
| Present invention steel | 1 | 0.10 | 2.0 | 1.5 | 0.026 | 0.0005 | 12.0 | 23.5 | 0.5 | 0.010 | 0.04 | 0.20 | 0.30 | | | | | 0.5 | | | |
| Present invention steel | 2 | 0.08 | 2.2 | 1.7 | 0.028 | 0.0006 | 14.2 | 25.6 | 0.8 | 0.005 | 0.05 | 0.20 | 0.28 | | | | | 0.8 | | | |
| Present invention steel | 3 | 0.12 | 2.1 | 0.8 | 0.02 | 0.0008 | 11.2 | 23.2 | 0.6 | 0.005 | 0.04 | 0.20 | 0.32 | | | | | 0.6 | | | |
| Present invention steel | 4 | 0.10 | 2.1 | 1.0 | 0.028 | 0.0006 | 12.0 | 24.0 | 1.1 | 0.005 | 0.03 | 0.20 | 0.30 | | | | | 1.1 | | | |
| Present invention steel | 5 | 0.10 | 2.5 | 1.0 | 0.028 | 0.0006 | 12.0 | 24.0 | 0.7 | 0.005 | 0.03 | 0.20 | 0.30 | | | | | 0.7 | | | |
| Present invention steel | 6 | 0.14 | 2.0 | 1.5 | 0.024 | 0.0007 | 12.0 | 24.0 | 1.1 | 0.004 | 0.03 | 0.12 | 0.26 | | | | | 1.1 | | | |
| Present invention steel | 7 | 0.10 | 2.0 | 1.5 | 0.027 | 0.0007 | 12.0 | 24.0 | 0.9 | 0.007 | 0.03 | 0.20 | 0.30 | | | | | 0.9 | | | |
| Present invention steel | 8 | 0.10 | 2.2 | 1.7 | 0.028 | 0.0006 | 12.0 | 24.0 | 1.2 | 0.005 | 0.04 | 0.20 | 0.30 | | | | | 1.2 | | | |
| Present invention steel | 9 | 0.10 | 2.2 | 1.8 | 0.028 | 0.0008 | 12.0 | 24.0 | 0.8 | 0.005 | 0.03 | 0.20 | 0.30 | | | | | 0.8 | | | |
| Present invention steel | 10 | 0.10 | 2.2 | 1.9 | 0.027 | 0.0006 | 12.0 | 24.0 | 0.9 | 0.006 | 0.04 | 0.20 | 0.30 | | | | | 0.9 | | | |
| Present invention steel | 11 | 0.10 | 2.2 | 1.5 | 0.028 | 0.0006 | 12.0 | 24.0 | 0.7 | 0.005 | 0.03 | 0.20 | 0.30 | | | | | 0.7 | | | |
| Present invention steel | 12 | 0.10 | 2.2 | 1.5 | 0.028 | 0.0006 | 12.0 | 24.0 | 0.7 | 0.005 | 0.03 | 0.20 | 0.30 | 0.3 | | | | 1.0 | | | |

TABLE 1A-continued (mass %)

| | No. | C | Si | Mn | P | S | Ni | Cr | Mo | Ti | Al | N | C + N | Nb | V | W | Co | Mo + Nb + V + W + Co | Cu | B | Sn |
|---|---|---|---|---|---|---|---|---|---|---|---|---|---|---|---|---|---|---|---|---|---|
| Present invention steel | 13 | 0.10 | 2.2 | 1.5 | 0.028 | 0.0006 | 12.0 | 24.0 | 0.7 | 0.005 | 0.03 | 0.20 | 0.30 | | 0.3 | | | 1.0 | | | |
| Present invention steel | 14 | 0.10 | 2.2 | 1.5 | 0.028 | 0.0006 | 12.0 | 24.0 | 0.7 | 0.005 | 0.03 | 0.20 | 0.30 | | | 0.3 | | 1.0 | | | |
| Present invention steel | 15 | 0.10 | 2.2 | 1.5 | 0.028 | 0.0006 | 12.0 | 24.0 | 0.7 | 0.005 | 0.03 | 0.20 | 0.30 | | | | 0.3 | 1.0 | | | |
| Present invention steel | 16 | 0.10 | 2.2 | 1.5 | 0.028 | 0.0006 | 12.0 | 24.0 | 0.7 | 0.005 | 0.03 | 0.20 | 0.30 | 0.05 | 0.1 | | | 0.9 | | | |
| Present invention steel | 17 | 0.10 | 2.2 | 1.5 | 0.028 | 0.0006 | 12.0 | 24.0 | 0.7 | 0.005 | 0.03 | 0.20 | 0.30 | 0.1 | | | 0.2 | 1.0 | | | |
| Present invention steel | 18 | 0.10 | 2.2 | 1.5 | 0.028 | 0.0006 | 12.0 | 24.0 | 0.7 | 0.005 | 0.03 | 0.20 | 0.30 | 0.1 | 0.1 | | | 0.9 | | | |
| Present invention steel | 19 | 0.10 | 2.2 | 1.5 | 0.028 | 0.0006 | 12.0 | 24.0 | 0.7 | 0.005 | 0.03 | 0.20 | 0.30 | 0.1 | | 0.1 | | 0.9 | | | |
| Present invention steel | 20 | 0.10 | 2.2 | 1.5 | 0.028 | 0.0006 | 12.0 | 24.0 | 0.7 | 0.005 | 0.03 | 0.20 | 0.30 | 0.1 | 0.1 | 0.1 | | 1.0 | 0.2 | | |
| Present invention steel | 21 | 0.10 | 2.2 | 1.5 | 0.028 | 0.0006 | 12.0 | 24.0 | 0.7 | 0.005 | 0.03 | 0.20 | 0.30 | 0.1 | | | 0.2 | 1.0 | 0.3 | 0.0005 | |
| Present invention steel | 22 | 0.10 | 2.0 | 1.5 | 0.026 | 0.0005 | 12.0 | 24.0 | 0.5 | 0.010 | 0.04 | 0.20 | 0.3 | 0.04 | 0.1 | 0.1 | 0.2 | 0.9 | 0.2 | 0.0004 | 0.01 |

TABLE 1B (mass %)

| | No. | C | Si | Mn | P | S | Ni | Cr | Mo | Ti | Al | N | C + N | Nb | V | W | Co | Mo + Nb + V + W + Co | Cu | B | Sn |
|---|---|---|---|---|---|---|---|---|---|---|---|---|---|---|---|---|---|---|---|---|---|
| Comparative steel | 23 | 0.04 | 2.5 | 1.0 | 0.026 | 0.0008 | 12.0 | 25.0 | 0.5 | 0.005 | 0.03 | 0.20 | 0.24 | | | | | 0.5 | | | |
| Comparative steel | 24 | 0.20 | 2.0 | 1.5 | 0.024 | 0.0008 | 12.0 | 24.0 | 0.6 | 0.005 | 0.03 | 0.20 | 0.40 | | | | | 0.6 | | | |
| Comparative steel | 25 | 0.10 | 0.8 | 1.5 | 0.028 | 0.0006 | 12.0 | 24.0 | 0.7 | 0.005 | 0.03 | 0.20 | 0.30 | | | | | 0.7 | | | |
| Comparative steel | 26 | 0.10 | 3.8 | 1.5 | 0.028 | 0.0005 | 12.0 | 25.0 | 0.7 | 0.005 | 0.03 | 0.20 | 0.30 | | | | | 0.7 | | | |
| Comparative steel | 27 | 0.10 | 2.5 | 0.2 | 0.028 | 0.0005 | 12.0 | 24.0 | 0.7 | 0.004 | 0.03 | 0.20 | 0.30 | | | | | 0.7 | | | |
| Comparative steel | 28 | 0.10 | 2.5 | 2.4 | 0.028 | 0.0005 | 12.0 | 25.0 | 0.7 | 0.005 | 0.03 | 0.20 | 0.30 | | | | | 0.7 | | | |
| Comparative steel | 29 | 0.10 | 2.5 | 1.5 | 0.06 | 0.0005 | 12.0 | 25.0 | 0.7 | 0.005 | 0.02 | 0.20 | 0.30 | | | | | 0.7 | | | |
| Comparative steel | 30 | 0.10 | 2.5 | 1.5 | 0.028 | 0.02 | 12.0 | 25.0 | 0.7 | 0.004 | 0.03 | 0.20 | 0.30 | | | | | 0.7 | | | |
| Comparative steel | 31 | 0.10 | 2.5 | 1.5 | 0.028 | 0.0005 | 9.0 | 25.0 | 0.7 | 0.005 | 0.04 | 0.20 | 0.30 | | | | | 0.7 | | | |
| Comparative steel | 32 | 0.10 | 2.5 | 1.5 | 0.026 | 0.0006 | 17.0 | 25.0 | 0.7 | 0.005 | 0.03 | 0.20 | 0.30 | | | | | 0.7 | | | |
| Comparative steel | 33 | 0.10 | 2.0 | 1.5 | 0.028 | 0.0006 | 12.0 | 21.0 | 0.7 | 0.004 | 0.03 | 0.20 | 0.30 | | | | | 0.7 | | | |
| Comparative steel | 34 | 0.10 | 2.0 | 1.5 | 0.028 | 0.0005 | 12.0 | 28.0 | 0.7 | 0.005 | 0.03 | 0.20 | 0.30 | | | | | 0.7 | | | |
| Comparative steel | 35 | 0.10 | 2.0 | 1.5 | 0.028 | 0.0004 | 12.0 | 25.0 | 0.3 | 0.005 | 0.05 | 0.20 | 0.30 | | | | | 0.3 | | | |
| Comparative steel | 36 | 0.10 | 2.0 | 1.5 | 0.028 | 0.0005 | 12.0 | 25.0 | 1.5 | 0.005 | 0.03 | 0.20 | 0.30 | | | | | 1.5 | | | |

TABLE 1B-continued (mass %)

| | No. | C | Si | Mn | P | S | Ni | Cr | Mo | Ti | Al | N | C + N | Nb | V | W | Co | Mo + Nb + V + W + Co | Cu | B | Sn |
|---|---|---|---|---|---|---|---|---|---|---|---|---|---|---|---|---|---|---|---|---|---|
| Comparative steel | 37 | 0.10 | 2.0 | 1.5 | 0.028 | 0.0009 | 12.0 | 25.0 | 0.7 | 0.005 | 0.03 | 0.05 | 0.15 | | | | | 0.7 | | | |
| Comparative steel | 38 | 0.10 | 2.0 | 1.5 | 0.028 | 0.0005 | 12.0 | 25.0 | 0.7 | 0.005 | 0.03 | 0.26 | 0.36 | | | | | 0.7 | | | |
| Comparative steel | 39 | 0.10 | 2.0 | 1.5 | 0.026 | 0.0003 | 12.0 | 25.0 | 0.7 | 0.004 | 0.004 | 0.20 | 0.40 | | | | | 0.7 | | | |
| Comparative steel | 40 | 0.10 | 2.0 | 1.5 | 0.028 | 0.0008 | 12.0 | 25.0 | 0.7 | 0.005 | 0.005 | 0.20 | 0.30 | | | | | 0.7 | | | |
| Comparative steel | 41 | 0.10 | 2.0 | 1.5 | 0.028 | 0.0007 | 12.0 | 25.0 | 0.7 | 0.005 | 0.15 | 0.20 | 0.30 | | | | | 0.7 | | | |
| Comparative steel | 42 | 0.10 | 2.0 | 1.5 | 0.028 | 0.0006 | 12.0 | 25.0 | 0.7 | 0.150 | 0.03 | 0.20 | 0.30 | | | | | 0.7 | | | |
| Comparative steel | 43 | 0.10 | 2.0 | 1.5 | 0.028 | 0.0005 | 12.0 | 25.0 | 0.7 | 0.005 | 0.03 | 0.20 | 0.30 | 0.7 | | | | 1.4 | | | |
| Comparative steel | 44 | 0.10 | 2.0 | 1.5 | 0.028 | 0.0008 | 12.0 | 25.0 | 0.7 | 0.005 | 0.03 | 0.20 | 0.30 | | 0.7 | | | 1.4 | | | |
| Comparative steel | 45 | 0.10 | 2.0 | 1.5 | 0.028 | 0.0007 | 12.0 | 25.0 | 0.7 | 0.005 | 0.03 | 0.20 | 0.30 | | | 0.7 | | 1.4 | | | |
| Comparative steel | 46 | 0.10 | 2.0 | 1.5 | 0.028 | 0.0005 | 12.0 | 25.0 | 0.7 | 0.005 | 0.03 | 0.20 | 0.30 | | | | 0.7 | 1.4 | | | |
| Comparative steel | 47 | 0.10 | 2.0 | 1.5 | 0.026 | 0.0005 | 12.0 | 23.5 | 0.5 | 0.010 | 0.04 | 0.20 | 0.30 | | | | | 0.5 | | | |
| Comparative steel | 48 | 0.10 | 2.0 | 1.5 | 0.026 | 0.0005 | 12.0 | 23.5 | 0.5 | 0.010 | 0.04 | 0.20 | 0.30 | | | | | 0.5 | 2.1 | | |
| Comparative steel | 49 | 0.10 | 2.0 | 1.5 | 0.026 | 0.0005 | 12.0 | 23.5 | 0.5 | 0.010 | 0.04 | 0.20 | 0.30 | | | | | 0.5 | | 0.01 | |
| Comparative steel | 50 | 0.10 | 2.0 | 1.5 | 0.026 | 0.0005 | 12.0 | 23.5 | 0.5 | 0.010 | 0.04 | 0.20 | 0.30 | | | | | 0.5 | | | 0.15 |

TABLE 2A

| | No. | Workability | High-temperature strength | Oxidation resistance |
|---|---|---|---|---|
| Present invention steel | 1 | A | B | A |
| Present invention steel | 2 | A | B | A |
| Present invention steel | 3 | A | B | A |
| Present invention steel | 4 | A | A | A |
| Present invention steel | 5 | A | B | A |
| Present invention steel | 6 | A | A | A |
| Present invention steel | 7 | A | B | A |
| Present invention steel | 8 | A | B | A |
| Present invention steel | 9 | A | B | A |
| Present invention steel | 10 | A | B | A |
| Present invention steel | 11 | A | B | A |
| Present invention steel | 12 | A | B | A |
| Present invention steel | 13 | A | B | A |
| Present invention steel | 14 | A | B | A |
| Present invention steel | 15 | A | B | A |
| Present invention steel | 16 | A | B | A |
| Present invention steel | 17 | A | B | A |
| Present invention steel | 18 | A | B | A |
| Present invention steel | 19 | A | B | A |
| Present invention steel | 20 | A | B | A |
| Present invention steel | 21 | A | B | A |
| Present invention steel | 22 | A | B | A |

TABLE 2B

| | No. | Workability | High-temperature strength | Oxidation resistance |
|---|---|---|---|---|
| Comparative steel | 23 | A | C | A |
| Comparative steel | 24 | C | C | A |
| Comparative steel | 25 | A | B | C |
| Comparative steel | 26 | C | C | A |
| Comparative steel | 27 | A | C | A |

TABLE 2B-continued

| | No. | Workability | High-temperature strength | Oxidation resistance |
|---|---|---|---|---|
| Comparative steel | 28 | C | C | C |
| Comparative steel | 29 | C | C | A |
| Comparative steel | 30 | C | C | A |
| Comparative steel | 31 | A | C | A |
| Comparative steel | 32 | C | C | A |
| Comparative steel | 33 | A | C | C |
| Comparative steel | 34 | C | C | A |
| Comparative steel | 35 | A | C | C |
| Comparative steel | 36 | C | C | C |
| Comparative steel | 37 | A | C | A |
| Comparative steel | 38 | C | C | A |
| Comparative steel | 39 | C | C | A |
| Comparative steel | 40 | A | C | A |
| Comparative steel | 41 | C | B | A |
| Comparative steel | 42 | A | C | A |
| Comparative steel | 43 | C | C | A |
| Comparative steel | 44 | C | C | A |
| Comparative steel | 45 | C | C | A |
| Comparative steel | 46 | C | C | A |
| Comparative steel | 47 | C | C | A |
| Comparative steel | 48 | C | C | C |
| Comparative steel | 49 | C | B | A |
| Comparative steel | 50 | C | B | A |

As is evident from Table 1A to Table 2B, the steel sheets having component formulations according to the present invention exhibited excellent properties for each of the workability, the high-temperature strength and the oxidation resistance. In contrast, the comparative examples which fell outside the ranges of the present invention failed in terms of at least one of the workability, the high-temperature strength and the oxidation resistance. Based on these results, it was clear that the steels of the present invention were superior to the austenitic stainless steels of the comparative examples.

INDUSTRIAL APPLICABILITY

As is evident from the preceding description, the heat-resistant austenitic stainless steel of the present invention exhibits excellent high-temperature strength and oxidation resistance, and also displays superior workability, and therefore a stainless steel sheet with excellent heat resistance can be provided. In other words, a material according to the present invention can be applied, in particular, to exhaust system components such as the exhaust pipes of vehicles, and enables an exhaust pipe to be provided that is capable of achieving greater engine efficiency for an automobile or the like. The present invention is extremely beneficial from an industrial perspective.

The invention claimed is:

1. A heat-resistant austenitic stainless steel sheet comprising:

in mass %, C: 0.05 to 0.15%, Si: more than 1.5% to 3.5%, Mn: 0.5 to 2.0%, P: not more than 0.04%, S: not more than 0.01%, Cr: 23.0 to 26.0%, Ni: 10.0 to 15.0%, Mo: 0.50 to 1.20%, Ti: not more than 0.1%, Al: 0.01 to 0.10%, N: 0.10 to 0.30%, Nb: 0.01 to 0.5%, V: 0.01 to 0.5%, W: 0.01 to 0.5%, Co: 0.01 to 0.5%, and Sn: 0.005 to 0.1%, wherein, a total amount of C and N (C+N) is from 0.25 to 0.35%, a total amount of Mo, Nb, V, W and Co (Mo+Nb+V+W+Co) is not more than 1.5%, and a balance is composed of Fe and unavoidable impurities.

2. The heat-resistant austenitic stainless steel sheet according to claim 1, wherein the total amount of Mo, Nb, V, W and Co (Mo+Nb+V+W+Co) is 0.1% or more and less than 1.2%.

3. The heat-resistant austenitic stainless steel sheet according to claim 1, further comprising, in mass %, one or more of Cu: 0.1 to 2.0%, and B: 0.0001 to 0.0050%.

4. The heat-resistant austenitic stainless steel sheet according to claim 1, wherein a high-temperature strength at 1,100° C., measured as a 0.2% proof stress, is 20 MPa or greater.

5. The heat-resistant austenitic stainless steel sheet according to claim 1, wherein a high-temperature strength at 1,100° C., measured as a 0.2% proof stress, is 30 MPa or greater.

6. The heat-resistant austenitic stainless steel sheet according to claim 1, wherein weight loss in a 1,100° C. intermittent oxidation test is not more than 50 mg/cm$^2$.

7. The heat-resistant austenitic stainless steel sheet according to claim 1, wherein, in mass %, the amount of Si is 1.60 to 2.0%.

8. The heat-resistant austenitic stainless steel sheet according to claim 1, wherein, in mass %, the amount of C is 0.10 to 0.15%.

9. A heat-resistant austenitic stainless steel sheet comprising:

in mass %, C: 0.05 to 0.15%, Si: more than 1.5% to 3.5%, Mn: 0.5 to 2.0%, P: not more than 0.04%, S: not more than 0.01%, Cr: 23.0 to 26.0%, Ni: 10.0 to 15.0%, Mo: 0.50 to 1.20%, Ti: not more than 0.1%, Al: 0.01 to 0.10%, N: 0.10 to 0.30%, Nb: 0.01 to 0.5%, V: 0.01 to 0.5%, W: 0.01 to 0.5%, Co: 0.01 to 0.5%, and Sn: 0.005 to 0.1%, wherein, a total amount of C and N (C+N) is from 0.25 to 0.35%, a total amount of Mo, Nb, V, W and Co (Mo+Nb+V+W+Co) is not more than 1.5%, and a balance comprising Fe and unavoidable impurities.

* * * * *